US010008053B2

(12) United States Patent
Turban et al.

(10) Patent No.: US 10,008,053 B2
(45) Date of Patent: Jun. 26, 2018

(54) ON-BOARD MAINTENANCE SYSTEM OF AN AIRCRAFT, AND ASSOCIATED AIRCRAFT

(75) Inventors: Laurent Turban, Bougival (FR); Magali Thorel, Paris (FR)

(73) Assignee: DASSAULT AVIATION, Paris (FR)

( * ) Notice: Subject to any disclaimer, the term of this patent is extended or adjusted under 35 U.S.C. 154(b) by 0 days. days.

(21) Appl. No.: 13/535,122

(22) Filed: Jun. 27, 2012

(65) Prior Publication Data

US 2013/0024050 A1 Jan. 24, 2013

(30) Foreign Application Priority Data

Jun. 29, 2011 (FR) ..... 11 02019

(51) Int. Cl.
*G07C 5/08* (2006.01)
*G07C 5/00* (2006.01)

(52) U.S. Cl.
CPC ..... *G07C 5/085* (2013.01); *G07C 5/006* (2013.01)

(58) Field of Classification Search
CPC .... G01C 23/00; G01C 23/005; G08G 5/0021; G08G 5/0013; G08G 5/0052
USPC ..... 726/13, 23, 24; 725/75; 370/401, 352, 370/328; 343/753
See application file for complete search history.

(56) References Cited

U.S. PATENT DOCUMENTS 7,634,329 B2 * 12/2009 Liu ..... G05B 23/0213 700/292
2006/0155425 A1 * 7/2006 Howlett ..... G05D 1/0055 701/1
2007/0115938 A1 * 5/2007 Conzachi et al. ..... 370/352
2007/0127460 A1 * 6/2007 Wilber ..... H04L 67/12 370/389
2007/0183435 A1 * 8/2007 Kettering et al. ..... 370/401
2008/0217471 A1 * 9/2008 Liu ..... G05B 23/0213 244/1 R
2010/0263024 A1 * 10/2010 Mahalingaiah ..... 726/4
2011/0054721 A1 3/2011 Goodrich et al.
(Continued)

FOREIGN PATENT DOCUMENTS

FR 2922705 A1 4/2009
FR 2952257 A1 5/2011

OTHER PUBLICATIONS

French Search Report and Written Opinion dated Feb. 2, 2012, French Application No. 1102019.

*Primary Examiner* — Jelani A Smith
(74) *Attorney, Agent, or Firm* — Davidson, Davidson & Kappel, LLC

(57) ABSTRACT

An on-board maintenance system for an aircraft, said aircraft comprising pieces of equipment connected together through a first on-board data transmission network for exchanging operational data intended for piloting the aircraft, said maintenance system including a processing unit and being characterized in that it comprises a second data transmission network, distinct from the first network, for exchanging data intended for maintenance of the equipment of the aircraft, said second network connecting at least some of said pieces of equipment to the processing unit; said processing unit are being adapted for receiving in real time, a data provided by the pieces of equipment on the second network and processing them with view to determining the cause of equipment malfunctions according to at least said received data.

15 Claims, 1 Drawing Sheet

(56) References Cited

U.S. PATENT DOCUMENTS

| | | | | |
|---|---|---|---|---|
| 2011/0149849 | A1* | 6/2011 | Brownrig | 370/328 |
| 2011/0218701 | A1* | 9/2011 | Ric et al. | 701/33 |

* cited by examiner

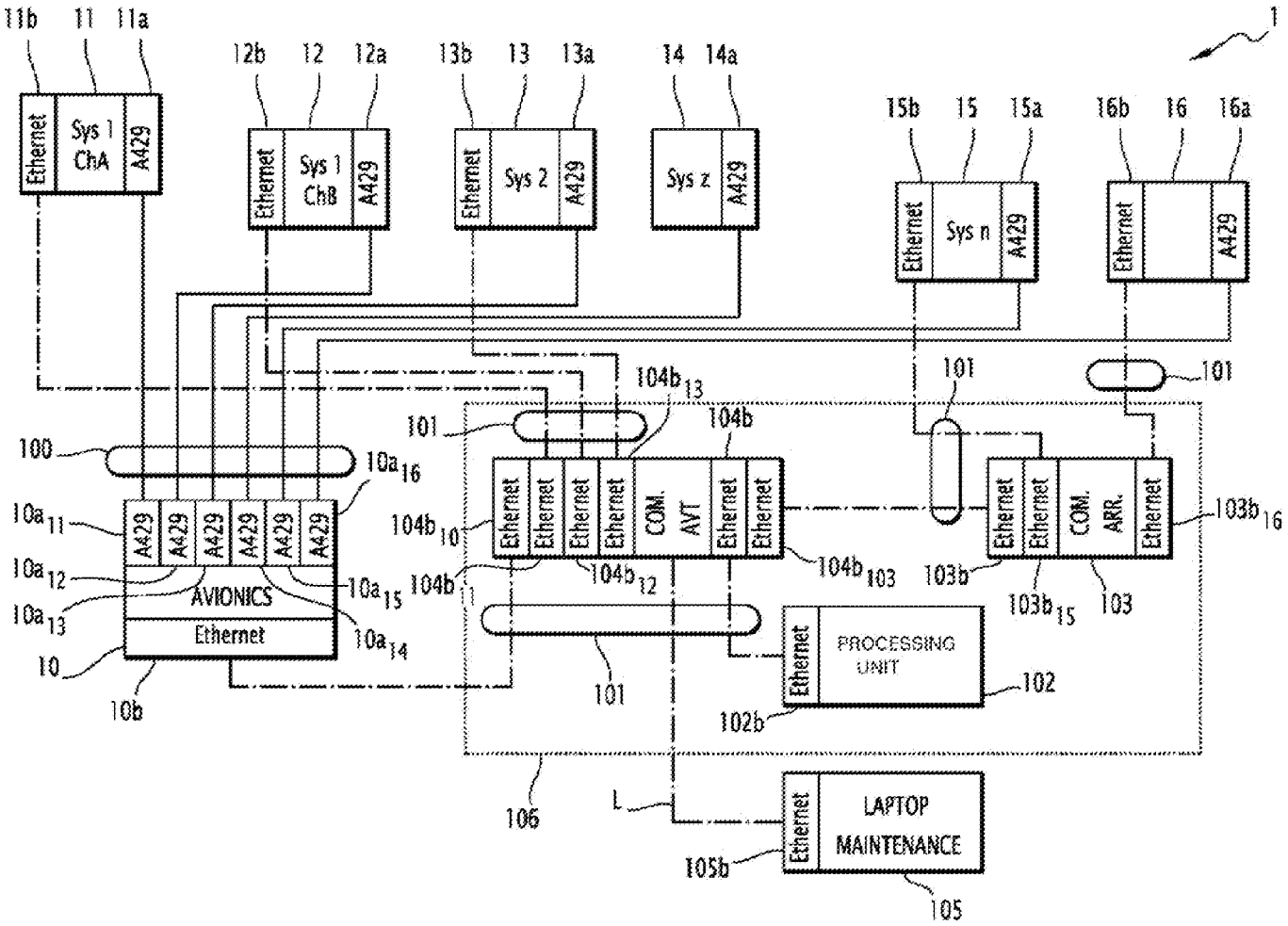
Ethernet
A429
Sys 1 ChA
Sys 1 ChB
Sys 2
Sys n
Sys z
COM. AVT
COM. ARR.
PROCESSING UNIT
LAPTOP MAINTENANCE
AVIONICS
Ethernet
1
10
10a
10b
11
11a
11b
12
12a
12b
13
13a
13b
14
14a
15
15a
15b
16
16a
16b
100
101
102
102b
103
103b
104b
105
105b
106
L

ON-BOARD MAINTENANCE SYSTEM OF AN AIRCRAFT, AND ASSOCIATED AIRCRAFT

CROSS-REFERENCE TO RELATED APPLICATIONS

This application claims benefit of French patent application serial number 11 02019, filed Jun. 29, 2011, which is herein incorporated by reference.

BACKGROUND OF THE INVENTION

Field of the Invention

The present invention relates to an on-board maintenance system of an aircraft, said aircraft comprising pieces of equipment connected together through a first on-board data transmission network for exchanging operational data intended for piloting the aircraft, said maintenance system including a processing unit.

The aircraft is for example a civilian or military airplane. An aircraft includes a large number of distinct, generally interconnected, mechanical, electrical and electronic functional pieces of equipment. These pieces of equipment may generate a multitude of distinct failures which result in a plurality of symptoms observable in the aircraft.

Description of the Related Art

An aircraft generally has a maintenance module which allows identification of the causes of the failures and/or the preventive maintenance operations to be carried out on these pieces of equipment.

In certain aircraft, for example in aircraft of the FALCON type, the pieces of equipment, including the maintenance module are interconnected through an operational digital network, for example complying with the ARINC 429 standard or ARINC 664 standard, recognized by flight certification authorities.

This digital network gives the possibility of conveying between the pieces of equipment the whole of the operational data during a flight of the aircraft. By operational data is meant the whole of the onboard data required for smoothly completing the flight, for piloting. Notably, upon identification of a failure of the system, these data may for example comprise a failure code for a piece of equipment, notably giving the possibility of informing the cockpit on this failure and optionally additional data allowing more specific characterization of this failure in order to allow smooth completion of the procedure to be applied in order to allow continuation of the flight.

This digital network additionally allows transmission to the maintenance module of raw data from the equipment. The maintenance module is dimensioned for storing these data and for analyzing them, with view to analyzing the original source of failures, to contributing to the repair of the aircraft.

However, the band width available on the digital network of the ARINC 429 type, connecting the pieces of equipment is limited by the throughput intrinsic to the standard, and is not sufficient for transmitting all the raw data elaborated by the equipment which may be useful for the maintenance module. Now, by having a large amount of raw data, it is possible to increase the efficiency of maintenance.

SUMMARY OF THE INVENTION

For this purpose, according to a first aspect, the object of the invention is an on-board maintenance system for an aircraft of the aforementioned type, characterized in that it comprises a second data transmission network distinct from the first network, for exchanging data intended for maintenance of the equipment of the aircraft, said second network connecting at least some of said pieces of equipment to the processing unit; said processing unit being adapted for receiving in real time, data provided by the pieces of equipment on the second network and for processing them in order to determine the cause of malfunctions of piece(s) of equipment according to at least said received data.

Such a maintenance system gives the possibility of transmitting to the processing unit of the maintenance system a large amount of raw data from the pieces of equipment, in order to conduct analysis and detection of malfunctions very efficiently. Further, while in the prior art, the developments of the software for the maintenance module integrated to the on-board operational digital network were highly constraining and limited because of the surrounding definitions filed as a flight certification of the aircraft and being applied to the network transmitting the operational data, with the invention it is possible to use more common software and hardware intended for the general public for implementing the second network, and the developments of the maintenance system are thus simplified since they are not subject to the constraints of certification.

In embodiments, the on-board maintenance system of an aircraft according to the invention further includes one or more of the following characteristics:

- an interface between the second network and a piece of equipment connected to said second network, positioned at the piece of equipment, comprises a suitable device for stopping the transfer of data transmitted from the second network to the piece of equipment;
- said device is adapted so as to prevent transfer of data transmitted from the second network to the piece of equipment except when a specific control signal is detected;
- the second network is a network of the Ethernet type;
- the on-board maintenance system comprising at least one or several Ethernet ports positioned at each piece of equipment connected to the second network, the data exchange between said piece of equipment and the second network being transferred via said Ethernet port(s);
- the device suitable for preventing transit of data transmitted from the second network to the piece of equipment is a firewall device included in a controller of the Ethernet port positioned at the piece of equipment;
- the second network comprises at least one Ethernet switch intended to be positioned between pieces of equipment connected to the second network and the processing unit and adapted so that the data from the pieces of equipment are exclusively provided to the processing unit;
- the second network comprises at least one Ethernet switch intended to be positioned in the front area of the aircraft, between pieces of equipment connected to the second network and the processing unit, and at least one other Ethernet switch intended to be positioned in the aft area of the aircraft, between pieces of equipment connected to the second network and the processing unit;
- the on-board maintenance system comprising a work station with a user interface having available a software package for consulting results determined by the processing unit according to the data provided by the pieces of equipment on the second network, said software package being able to be activated only when the aircraft is on the ground.

According to a second aspect, the object of the invention is an aircraft comprising pieces of equipment connected together through a first on-board digital network intended for exchanging operational data useful for piloting the aircraft, and a maintenance system according to the first aspect of the invention.

BRIEF DESCRIPTION OF THE DRAWINGS

The invention will be better understood upon reading the description which follows and examining the single FIGURE which accompanies it. This FIGURE is given as an illustration but is by no means a limitation of the invention.

The single FIGURE is a schematic functional view of an aircraft 1 in an embodiment of the invention. The aircraft 1 comprises a set of mechanical, electrical and/or electronic on-board functional systems intended for operating the aircraft 1.

Each of these onboard systems includes at least one computer interface with the pieces of equipment of the system. In the following, the term of "computer" may in fact also designate each computer from a group of computers with interfaces with the pieces of equipment for the system. A computer comprises a suitable memory for storing data and a microprocessor. A computer is suitable for centralizing and storing data from pieces of equipment in the system (raw operating data, failure identification . . . ) and for allowing information exchange with the outside of the system.

DETAILED DESCRIPTION

In the relevant embodiment, the computer collects a set of raw operating data from various pieces of equipment of the system with which it is associated. These raw operating data are notably related to the condition of the pieces of equipment, to their operating mode, to measurements relating to the equipment (temperature, pressure, frequency, speed, voltage, self-test, etc).

These collected raw data may in some cases be subject to local processing operations by the computer of the system (for detection, storage and memory, sorting, averaging, for statistics, for applying algorithms, for determining a failure code, etc) which infers therefrom operational data, for example, a code for identifying failures, elements intended for display on the user interfaces of the cockpit.

In the relevant embodiment, for example the computer 10 is the computer interfaced with the whole of the equipment present in the cockpit (the equipment of the "Avionics" system) and which includes a user interface, notably on-board receivers, on-board radars, dashboard instruments.

The computer 10 further includes interfaces $\mathbf{10}a_{11}$, $\mathbf{10}a_{12}$, $\mathbf{10}a_{13}$, $\mathbf{10}a_{14}$, $\mathbf{10}a_{15}$ and $\mathbf{10}a_{16}$ with a digital data transmission network, for example compliant with the ARINC 429 standard, detailed hereafter. This network is used for exchanging operational data.

The computer 10 is further provided with an interface with a data transmission network of the Ethernet type, detailed hereafter and used for exchanging data relating to maintenance. This interface includes an Ethernet port 10*b*.

The computer 11 is the computer of a chain A of the braking system 1.

The chain A of the braking system 1 for example includes a hydraulic accumulator, solenoid valves controlled by the computer 11 and connected to the hydraulic pump and pressure gauge contactors respectively connected to the left brake of the aircraft, to the right brake and to the hydraulic circuit. The chain A further includes detectors capable of measuring the presence of pressure at the pressure gauges and of detecting symptoms of failures according to these measurements.

The computer 11 further includes an interface 11*a* with the operational digital network compliant with the ARINC 429 standard.

The computer 11 is further provided with an interface with the Ethernet network. This interface includes an Ethernet port 11*b*.

The computer 12 is the computer of the second chain B of the braking system 1. The chain B includes elements similar to those of chain A. The braking system 1 thus includes an active braking chain and an emergency chain, which is only used when the active chain has failed.

The computer 12 includes an interface 12*a* with the ARINC 429 network and an interface including an Ethernet port 12*b*, with the Ethernet network.

In the relevant embodiment, for example the computer 13 is a computer interfaced with the whole of the pieces of equipment of the landing gear system. The computer 13 further includes an interface 13*a* with the ARINC 429 and an interface including an Ethernet port 13*b*, with the Ethernet network.

In the relevant embodiment, for example the computer 14 is a computer interfaced with the whole of the pieces of equipment of the ground control system. The computer 14 further includes an interface 14*a* with the ARINC 429 network.

In the relevant embodiment, for example the computer 15 is a computer interfaced with the whole of the pieces of equipment of the engine system. The computer 15 further includes an interface 15*a* with the ARINC 429 network and an interface including an Ethernet port 15*b*, with the Ethernet network.

In the relevant embodiment, for example the computer 16, is a computer interfaced with the whole of the pieces of equipment of the fuel management system. The computer 16 further includes an interface 16*a* with the ARINC 429 network and an interface including an Ethernet port 16*b* with the Ethernet network.

In the relevant embodiment, each respective computer i, for i equal to 11, 12, 13, 14, 15 and 16 respectively of the braking, landing, ground control, engine and fuel handling system is connected via its respective ARINC 429 interface is and a respective link 100 compliant with the ARINC 429 standard, at the ARINC 429 interface 10*ai*, of the computer of the piloting system.

The computer 10 of the piloting system receives via these links 100, operational data delivered by the computers 11-16 with view to informing the pilots, so that they may adapt in real time the piloting of the aircraft.

Moreover, the aircraft includes an on-board maintenance system 106.

The maintenance system 106 includes a processing unit 102 having an Ethernet port 102*b*, the maintenance unit 102 further includes a memory area storing all the flight data and data analysis software packages with view to detecting causes of failures and to contributing to repair. The maintenance unit 102 further includes a microprocessor adapted for executing these pieces of software.

The maintenance system 106 also includes two Ethernet switches 103, 104 with which the whole of the data emitted by the whole of the computers may be collected. The Ethernet switch 103 includes the Ethernet ports 103*b*, 103$b_{15}$, 103$b_{16}$.

The Ethernet switch 104 includes the Ethernet ports 104*b*, 104$b_{103}$, 104$b_{10}$, 104$b_{11}$, 104$b_{12}$, 104$b_{13}$.

The maintenance system 106 also comprises links 101 compliant with the Ethernet standard (ISO/IEC 8802-3).

In the relevant embodiment, the computer of each system except for the ground control system 14 is connected through an Ethernet communications link 101 to the maintenance system 106.

Thus, the computer of the piloting system via its Ethernet port 10*b* is connected through a dedicated link 101 to the Ethernet port 104$b_{11}$ of the Ethernet switch 104. Also, the computer 11 via its Ethernet port 11*b* is connected through a dedicated link 101 to the Ethernet port 104$b_{10}$ of the Ethernet switch 104. Similarly, each computer 12, 13 respectively via its Ethernet port respectively 12*b*, 13*b* is connected through a dedicated link 101 to the Ethernet port, 104$b_{12}$, 104$b_{13}$ respectively of the Ethernet switch 104.

The computer 15 of the engine system via its Ethernet port 15*b* is connected through a dedicated link 101 to the Ethernet port 103$b_{15}$ of the Ethernet switch 103.

The computer 16 of the fuel management system via its Ethernet port 16*b* is connected through a dedicated link 101 to the Ethernet port 103$b_{16}$ of the Ethernet switch 103.

The switch 103 via its Ethernet port 103*b* is connected through an Ethernet link 101 to the Ethernet port 104$b_{103}$ of the switch 104.

And the switch 104 via its Ethernet port of 104*b* is connected through an Ethernet link 101 to the Ethernet port 102*b* of the processing unit 102.

In the relevant embodiment, the switch 104 is connected to equipment located in the front of the aircraft, while the switch 103 is connected to equipment located in the rear of the aircraft.

In the relevant embodiment, the throughput allowed by a link 101 is comprised in a range compatible with the Ethernet technology in effect (10 MBit/s to at least 1 GBit/s).

The provision of the data from the pieces of equipment of the systems of the aircraft and intended for the processing unit 102 of the maintenance system 106 is described below.

These data include for each system, raw data from the pieces of equipment of the system and provided to the computer of the system, as well as optionally data from results determined by the computer according to some of these raw data.

These data are designated hereafter by "raw data".

In the relevant embodiment, the computer 14 of the ground control system which does not have any Ethernet port for connecting it to the maintenance system 106 is adapted so as to transmit from its interface 14*a*, via the operational link 100 and intended for the interface 10$a_{14}$ of the computer 10, raw data from the pieces of equipment of the ground control system.

The computer 10 is adapted for associating these data with an identifier of the ground control system, so that the processing unit 102, upon receiving these data, may identify that they relate to the ground control system.

In the relevant embodiment, the raw data from the pieces of equipment of the piloting system and provided to the computer 10 are transmitted in real time and continuously, from the Ethernet port 10*b* of the computer 10, to the processing unit 102, via the Ethernet links 101.

These data delivered by the computer 10 are first transmitted to the Ethernet port 104$b_{10}$ of the switch 104.

In the same way, the raw data provided to the computer i, for i equal to 11, 12, 13, respectively by the pieces of equipment of the system associated with the computer, are transmitted in real time and continuously, from the Ethernet port ib of the computer i, intended for the processing unit 102 of the maintenance system 106, via the Ethernet links 101.

These data delivered by the computer i are in reality first transmitted to the Ethernet port 104*bi* of the switch 104.

The raw data provided to the computer j, with j respectively equal to 15, 16, by the pieces of equipment of the system associated with the computer j, are transmitted in real time and continuously, from the Ethernet port respectively jb of the computer j intended for the processing unit 102 via the Ethernet links 101.

These data delivered by the computer j are in reality first transmitted to the Ethernet port 103*bj* of the switch 103.

The switch 103 is adapted for receiving these data provided by the computers 15, 16 and for multiplexing these data stemming from different sources so as to deliver them to the Ethernet port 104$b_{103}$ of the switch 104, according to determined multiplexing rules.

Similarly, the switch 104 is adapted for receiving the data from the whole of the computers 10, 12, 12, 13, 15, 16 and from the switch 103 and for multiplexing these data stemming from different sources so as to deliver them, from the Ethernet port 104*b* to the Ethernet port 102$b_{103}$ of unit 102, according to determined multiplexing rules.

In the relevant embodiment, all the data, in real time and along the way, during a flight of the aircraft, transmitted by the computers of the system through the Ethernet links are directed towards the switch 104, directly or via the switch 103. The switch 104 is adapted for transmitting all these data exclusively to the processing unit 102 and controlling this transmission.

The processing unit 102 is adapted for receiving and storing in memory these raw data received from the pieces of equipment. It is adapted for processing these different data so as to identify the causes of failures and/prevent future equipment malfunctions. The results of this processing are stored in the memory of the processing unit 102.

Thus, in the relevant embodiment with reference to the single figure, the raw data intended for analysis by the maintenance system are delivered to the maintenance system via the Ethernet network. The maintenance system 106 is not connected to the operational ARINC 429 and is therefore not subject to the constraints associated with flight certification. This provision allows greater flexibility as to carrying out and developing maintenance functionalities (update of software packages, etc), by decorrelating the latter from the certified operational network.

In an embodiment, the controller of the Ethernet port of the computer 10, 11, 12, 13, 15 and/or 16 connected to the Ethernet links 101, includes a firewall device. This firewall device is adapted so as to reject transfer of any datum stemming from an Ethernet link and intended for a computer.

This provision prevents any risk of introducing into the pieces of equipment of the systems associated with the computers, a computer virus from the Ethernet network.

In an embodiment, this firewall device in the Ethernet port of the computer is adapted so as to reject transfer of any datum from the Ethernet link 101 and intended for the computer, except in the presence of a control signal provided to the computer. In an embodiment, this control signal is only provided when the aircraft is on the ground and has switched to maintenance mode (this corresponds to the transition of a wired switch into a determined state).

In an embodiment, this firewall is applied at the hardware, software and at the UDP communications protocol applied by the Ethernet port.

In an embodiment, the maintenance system 106 includes a work station 105 with a user interface, for example a computer provided with a screen and provided with an Ethernet port 105*b*. An Ethernet link is placed between the work station 105 and the switch 104. In the relevant embodiment, this link can only be activated when the airplane is on the ground.

From this work station and via the switch 104, an operator may have access to the results of the analyses and processes applied and stored per processing unit 102, after an optional authentication procedure between the operator from his/her work station and the processing unit 106 via the switch 104.

In an embodiment, the operator may further control the application of maintenance tests, according to which depending on the commands issued by the operator from his/her work station 105, test scenarios including software instructions are transmitted from the work station to the computer of at least one system, via the Ethernet links and ports, in a direction opposite to the one considered above for transferring raw data. These tests can only be taken into account by the computers if the control signal allowing data transfer from the Ethernet network towards the computer has actually been provided. Following the execution of these tests by the computer, involving if necessary other pieces of equipment of the system associated with the computer, new corresponding raw data are transmitted to the unit 102.

For example, a test scenario is adapted for replaying the background observed during flight.

In the relevant embodiment above, the maintenance system includes two Ethernet switches. In other embodiments of the invention, any number of switches greater than or equal to zero are used, depending on the number of Ethernet ports to be collected notably.

In an embodiment, the switch 104 is connected to equipment located on the left of the aircraft, while the switch 103 is connected to the equipment located on the right of the aircraft.

A network of the Ethernet type has been described for achieving the network for transmitting data intended for the maintenance system. Other technologies may nevertheless be used.

The invention claimed is:

1. An on-board maintenance system of an aircraft comprising:

a set of on-board computers of on-board functional systems of the aircraft, each on-board computer being configured for centralizing and storing data from pieces of equipment in the respective on-board functional system;

a first on-board data transmission network including first links connecting together the on-board computers of the on-board functional systems for exchanging operational data intended for piloting the aircraft;

an on-board processing unit; and a second on-board network, distinct from the first on-board data transmission network, for exchanging data intended for maintenance of the pieces of equipment of the aircraft, said second on-board network comprising second links, distinct from the first links, connecting said on-board computers to the on-board processing unit, each link connecting one of said on-board computers to the on-board processing unit;

said on-board processing unit being adapted for receiving in real time, data provided by the pieces of equipment to the computers on the second on-board network through said second links, for processing them, and for determining a cause of malfunctions of the pieces of equipment, according to at least said received data, the pieces of equipment include at least one of piece of a braking system of the aircraft, a landing gear system of the aircraft, a ground control system of the aircraft, an engine system of the aircraft and a fuel management system of the aircraft, the first on-board transmission network being a flight certified network, the on-board maintenance system being decorrelated from the first on-board transmission network such that the on-board maintenance system is not subjected to flight certification constraints.

2. The on-board maintenance system of an aircraft according to claim 1, wherein an interface between the second on-board network and a piece of equipment connected to said second on-board network, positioned at the piece of equipment comprises a suitable device for stopping a transfer of data transmitted from the second on-board network to the piece of equipment.

3. The on-board maintenance system of an aircraft according to claim 2, wherein said device is suitable for preventing the transfer of data transmitted from the second on-board network to the piece of equipment except for when a specific control signal is detected.

4. The on-board maintenance system of an aircraft according to claim 1, wherein the second on-board network is a network of an Ethernet type.

5. The on-board maintenance system of an aircraft according to claim 4, comprising at least one or several Ethernet ports positioned at each piece of equipment connected to the second on-board network, the data exchange between said piece of equipment and the second on-board network being transferred via said Ethernet port(s).

6. The on-board maintenance system of an aircraft according to claim 5, wherein an interface between the second on-board network and a piece of equipment connected to said second on-board network, positioned at the piece of equipment, comprises a suitable device for stopping a transfer of data transmitted from the second on-board network to the piece of equipment, the suitable device suitable for preventing stopping the transfer of data transmitted from the second on-board network to the piece of equipment being a firewall device included in a controller of the Ethernet port, positioned at the piece of equipment.

7. The on-board maintenance system of an aircraft according to claim 4, wherein the second on-board network comprises at least one Ethernet switch intended to be positioned between pieces of equipment connected to the second on-board network and the on-board processing unit and adapted so that the data from the pieces of equipment are exclusively provided to the on-board processing unit.

8. The on-board maintenance system of an aircraft according to claim 7, wherein the second on-board network comprises at least one Ethernet switch intended to be positioned in a front area of the aircraft, between pieces of equipment connected to the second on-board network and the on-board processing unit, and at least one other Ethernet switch intended to be positioned in an aft area of the aircraft, between pieces of equipment connected to the second on-board network and the on-board processing unit.

9. The on-board maintenance system of an aircraft according to claim 1, comprising a workstation with a user interface having software for consulting results determined by the on-board processing unit according to data provided by the pieces of equipment on the second on-board network, said software only being able to be activated when the aircraft is on the ground.

10. An on-board maintenance system of an aircraft, said aircraft comprising pieces of equipment connected together through a first on-board data transmission network for exchanging operational data intended for piloting the aircraft, said on-board maintenance system including an on-board processing unit and comprising a second on-board network, distinct from the first on-board data transmission network, for exchanging data intended for maintenance of the pieces of equipment of the aircraft, said second on-board network connecting at least some of said pieces of equipment to the on-board processing unit, wherein said on-board maintenance system is not connected to the first on-board data transmission network;

said on-board processing unit being adapted for receiving in real time, data provided by the pieces of equipment on the second on-board network, for processing them, and for determining a cause of malfunctions of the pieces of equipment, according to at least said received data, the equipment being mechanical, electrical and/or electronic functional pieces of equipment, the operational data being data related to related to a condition of at least one of the pieces of equipment, to an operating mode of at least one of the pieces of equipment and/or to measurements relating to at least one of the pieces of equipment, the on-board maintenance system being configured to output, for display on user interfaces in the aircraft, a representation identifying the determined cause of malfunction.

11. The on-board maintenance system of an aircraft according to claim 10, wherein the representation identifying the determined cause of malfunction is a failure code.

12. An on-board maintenance system of an aircraft, the aircraft comprising pieces of equipment connected together through a first on-board data transmission network for exchanging operational data intended for piloting the aircraft, said on-board maintenance system comprising:

an on-board processing unit; and a second on-board network, distinct from the first on-board data transmission network, for exchanging data intended for maintenance of the pieces of equipment of the aircraft, said second on-board network connecting at least some of said pieces of equipment to the on-board processing unit, wherein said maintenance system is not connected to the first on-board data transmission network;

said on-board processing unit being adapted for receiving in real time, all raw data elaborated by the pieces of equipment useful for maintenance of the aircraft on the second on-board network, for processing them and for determining a cause of malfunctions of the pieces of equipment, according to at least said received data, the pieces of equipment include at least one of piece of a braking system of the aircraft, a landing gear system of the aircraft, a ground control system of the aircraft, an engine system of the aircraft and a fuel management system of the aircraft, the first on-board transmission network being a flight certified network, the on-board maintenance system being decorrelated from the first on-board transmission network such that the on-board maintenance system is not subjected to flight certification constraints.

13. The on-board maintenance system of an aircraft according to claim 12 wherein the on-board maintenance system is configured for running software that is not limited by surrounding definitions filed for flight certification of the aircraft.

14. The on-board maintenance system of an aircraft according to claim 12 wherein the on-board maintenance system is not connected to ARINC 429 constrained components.

15. An on-board maintenance system of an aircraft comprising:

a set of on-board computers of on-board functional systems of the aircraft, each on-board computer being configured for centralizing and storing data from pieces of equipment in the respective on-board functional system;

a first on-board data transmission network including first links connecting together the on-board computers of the on-board functional systems for exchanging operational data intended for piloting the aircraft;

an on-board processing unit; and a second on-board network, distinct from the first on-board data transmission network, for exchanging data intended for maintenance of the pieces of equipment of the aircraft, said second on-board network comprising second links, distinct from the first links, connecting said on-board computers to the on-board processing unit, each link connecting one of said on-board computers to the on-board processing unit;

said on-board processing unit being adapted for receiving in real time, data provided by the pieces of equipment to the computers on the second on-board network through said second links, for processing them, and for determining a cause of malfunctions of the pieces of equipment, according to at least said received data, the equipment being mechanical, electrical and/or electronic functional pieces of equipment, the operational data being data related to related to a condition of at least one of the pieces of equipment, to an operating mode of at least one of the pieces of equipment and/or to measurements relating to at least one of the pieces of equipment, the on-board maintenance system being configured to output, for display on user interfaces in the aircraft, a representation identifying the determined cause of malfunction.

* * * * *